US010743628B2

(12) United States Patent
Leimer

(10) Patent No.: US 10,743,628 B2
(45) Date of Patent: Aug. 18, 2020

(54) CELL PHONE MOUNT AND WALLET

(71) Applicant: Handstands Promo, LLC, Salt Lake City, UT (US)

(72) Inventor: Stefan Leimer, Salt Lake City, UT (US)

(73) Assignee: Handstand Promo, LLC, Salt Lake City, UT (US)

( * ) Notice: Subject to any disclaimer, the term of this patent is extended or adjusted under 35 U.S.C. 154(b) by 23 days.

(21) Appl. No.: 15/978,582

(22) Filed: May 14, 2018

(65) Prior Publication Data

US 2018/0325228 A1 Nov. 15, 2018

Related U.S. Application Data

(60) Provisional application No. 62/506,343, filed on May 15, 2017.

(51) Int. Cl.

| | |
|---|---|
| ***A45C 1/06*** | (2006.01) |
| ***A45C 11/18*** | (2006.01) |
| ***A45C 13/10*** | (2006.01) |
| *A45C 11/00* | (2006.01) |

(52) U.S. Cl.

CPC ..... *A45C 1/06* (2013.01); *A45C 11/182* (2013.01); *A45C 13/1092* (2013.01); *A45C 2001/067* (2013.01); *A45C 2011/002* (2013.01); *A45C 2200/15* (2013.01)

(58) Field of Classification Search

CPC ... A45C 11/182; A45C 1/06; A45C 2011/002; A45C 2011/007

USPC ..... 206/320; 150/147; 455/575.1

See application file for complete search history.

(56) References Cited

U.S. PATENT DOCUMENTS

| | | | | |
|---|---|---|---|---|
| 8,726,952 | B2 * | 5/2014 | Jambunathan | A45C 11/00 150/134 |
| 2007/0057004 | A1 * | 3/2007 | Butler | A45C 11/182 224/669 |
| 2010/0294405 | A1 * | 11/2010 | Longinotti-Buitoni | A45C 11/00 150/165 |
| 2011/0034221 | A1 * | 2/2011 | Hung | A45C 11/00 455/575.8 |
| 2011/0294556 | A1 * | 12/2011 | Carlberg | A45C 11/00 455/575.8 |
| 2011/0297566 | A1 * | 12/2011 | Gallagher | F16M 11/105 206/320 |
| 2013/0210503 | A1 * | 8/2013 | Keesling | H04M 1/0279 455/575.1 |

(Continued)

*Primary Examiner* — Sue A Weaver

(74) *Attorney, Agent, or Firm* — Thorpe, North & Western, LLP

(57) ABSTRACT

A combination mount and wallet for a cellular phone removably mounts the cellular phone to a dashboard of a vehicle, and removably receives one or more credit cards, driver's license, etc. A base is affixed to the dashboard of the vehicle. A mount plate is carried by the base on an articulated joint, such as a ball-and-socket joint. The mount plate has a hook portion of a hook-and-loop type fastener. A card or wallet is affixed to the cellular phone. The card or wallet has a loop portion of the hook-an-loop type fastener. Thus, the card or wallet can be removably affixed to the mount plate, and thus the dashboard via the hook-and-loop type fastener. In addition, the wallet forms a pocket with the cellular phone to receive the one or more credit cards, driver's license, etc.

19 Claims, 6 Drawing Sheets

(56) References Cited

U.S. PATENT DOCUMENTS

| | | | | |
|---|---|---|---|---|
| 2014/0357328 | A1* | 12/2014 | Aharon | H04M 1/04 455/575.1 |
| 2015/0102073 | A1* | 4/2015 | Pusateri | H04B 1/3888 224/191 |
| 2016/0173670 | A1* | 6/2016 | Langhein | H04M 1/04 455/575.1 |
| 2017/0196331 | A1* | 7/2017 | Gluck | A45C 11/182 |
| 2018/0235338 | A1* | 8/2018 | Lamb | A45C 13/001 |
| 2019/0269212 | A1* | 9/2019 | Swart | A45C 13/005 |

* cited by examiner

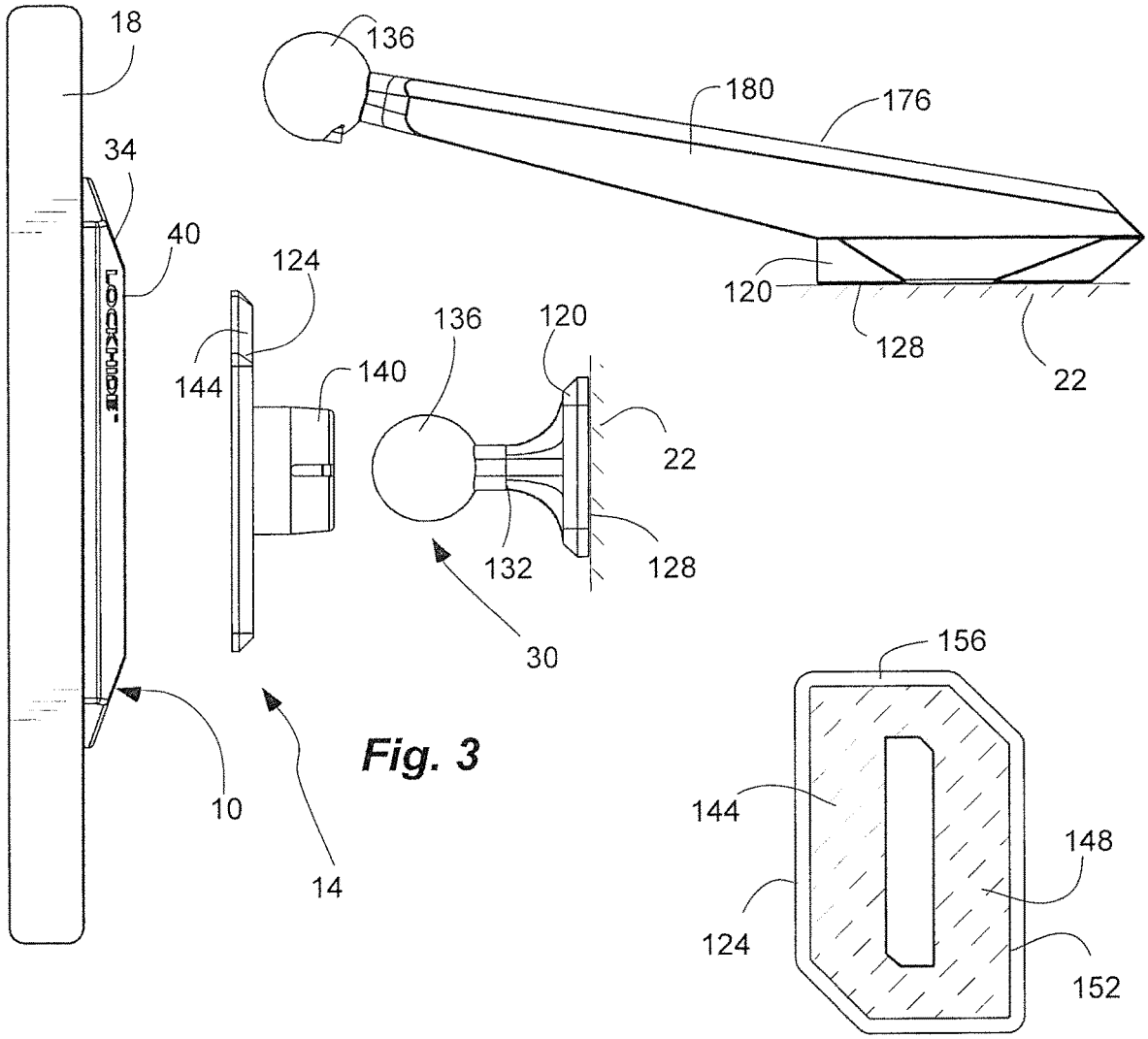
Fig. 3
Fig. 4
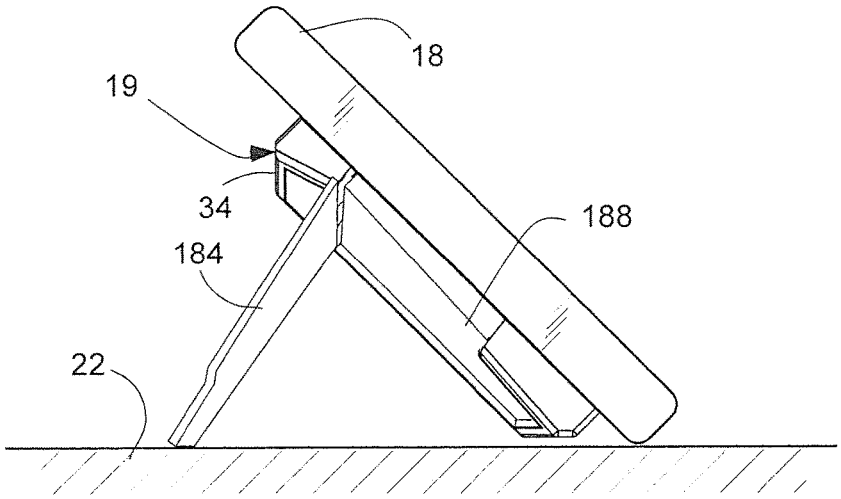
Fig. 1c

CELL PHONE MOUNT AND WALLET

Priority is claimed to U.S. Provisional Patent Application Ser. No. 62/506,343, filed May 15, 2017, which is hereby incorporated herein by reference.

BACKGROUND

Field of the Invention

The present invention relates generally to cellular phone accessories. More particularly, the present invention relates to a combination cellular phone mount and wallet.

Related Art

Cellular phones can display maps and provide driving instructions. Thus, it can be desirable to position a cellular phone in a vehicle so that the maps and directions can be viewed while driving. A magnetic mount has been proposed that attaches a magnet or metal plate to the dash, and a metal plate or magnet to the cellular phone to magnetically attach the cellular phone to the dash. Such metal plates are often attached to the back of the phone and/or between the phone and a case of the phone. Such metal plates, however, can interfere with wireless charging. In addition, such magnets can affect the phone, and/or magnetic strips on credit cards and the like that may inadvertently come in contact with the magnet.

In addition, cellular phones are increasing being utilized as a replacement to wallets and/or purses, yet it is still often necessary to carry cards, such as driver's license, credit cards, etc, and cash. Flexible pockets have been proposed that attached to the back of the phone, and carry such cards. But such pockets can interfere with mounting systems.

SUMMARY OF THE INVENTION

It has been recognized that it would be advantageous to develop a mounting system without magnets and without interfering with the operation of the phone, and that is compatible with also carrying items, such as cards.

The invention provides a combination mount and wallet for a cellular phone to removably mount the cellular phone to a dashboard of a vehicle, and to removably receive one or more credit cards, driver's license, etc. The wallet comprises a rigid shell to be affixed to a back of the cell phone, and having an inner side and an exterior side. A recess is in the inner side of the shell sized and shaped to removably receive at least one card. A perimeter wall extends around a majority of the inner side of the shell and defines a majority of a perimeter of the recess. A gap in the perimeter wall defines an open slot into the recess. The open slot receives the at least one card therethrough. An adhesive is on the perimeter wall to affix the shell to the cell phone.

In accordance with another aspect, the wallet can have a strap with a proximal fixed end affixed to the shell, an intermediate portion forming a loop in the recess, and a distal free end releasably coupled to the shell to secure the at least one card in the recess. The wallet can further comprise a clasp. The clasp can comprise a receptacle formed in the shell adjacent the gap. A buckle is attached to the distal free end of the strap and is removably received in the receptacle. The strap and the buckle have a closed configuration with the buckle received in the receptacle and the strap extending around and over the at least one card, and an open configuration with the buckle removed from the receptacle.

In accordance with another aspect, the wallet can have a base to removably couple the wallet, and thus the cell phone, to a dashboard of a vehicle. The base can comprise a foot and an adhesive on the foot to affix the foot to the dashboard of the vehicle. A neck extends from the foot. A ball is disposed on the neck. A mount plate is coupled to the ball of the foot. The mount plate comprises a socket receiving the ball of the foot and defining a ball-and-socket joint between the foot and the mount plate. A face is opposite the socket with a sheet comprising a portion of a hook-and-loop type fastener. The face of the mount plate removably couples to the exterior side of the shell.

BRIEF DESCRIPTION OF THE DRAWINGS

Additional features and advantages of the invention will be apparent from the detailed description which follows, taken in conjunction with the accompanying drawings, which together illustrate, by way of example, features of the invention; and, wherein:

FIG. 1*c* is a side view of the cell phone mount and wallet of FIG. 1*a*, shown with a kickstand in an extended position to support the cell phone on a support surface;

FIG. 3 is an exploded view of a kit with the cell phone mount and wallet of FIG. 1*a*, along with a base to releasably mount the cell phone mount and wallet along with the cell phone to a support surface;

FIG. 4 is a front view of the mount plate of the cell phone mount and wallet of FIG. 1*a;*

Figure 2A:
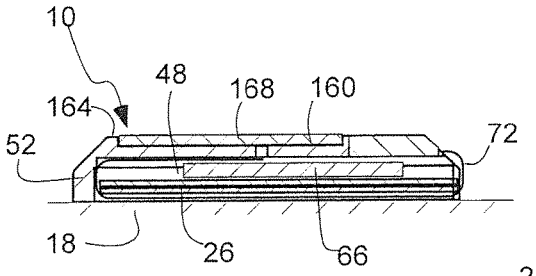
FIG. 2*a* is a cross-sectional side view of the cell phone mount and wallet of FIG. 1*a*, taken along line 2*a* of FIG. 1*a;*
Figure 1A:
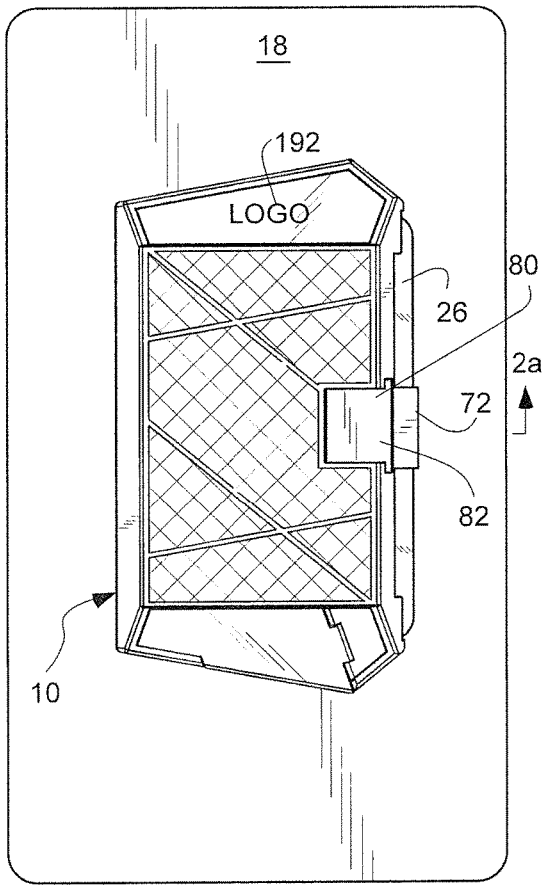
FIG. 1*a* is a front view of a cell phone mount and wallet in one example of the invention, shown disposed on a cell phone and with a card disposed therein and retained by a strap in a closed configuration.
Figure 1B:
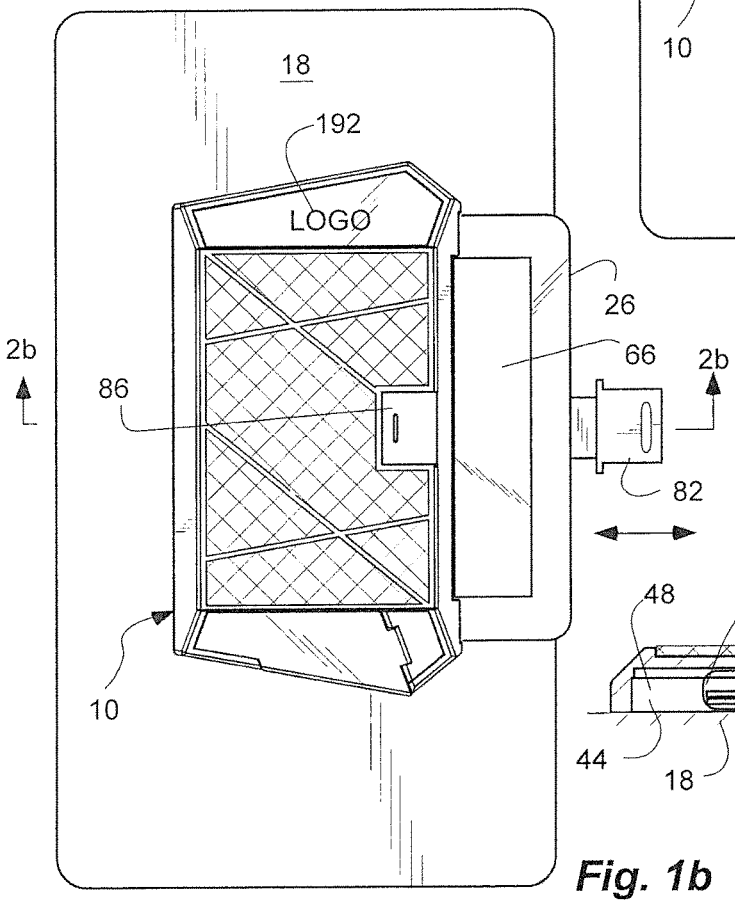
FIG. 1*b* is a front view of the cell phone mount and wallet of FIG. 1*a*, shown with the strap in an open configuration.
Figure 2B:
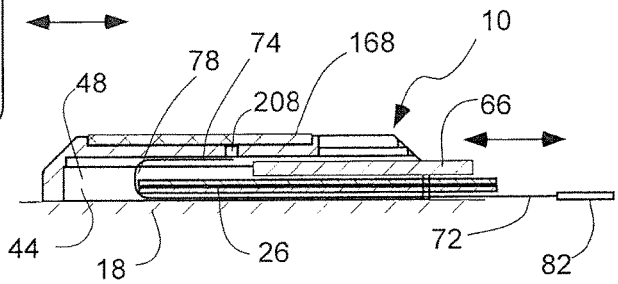
FIG. 2*b* is a cross-sectional side view of the cell phone mount and wallet of FIG. 1*a*, taken along line 2*b* of FIG. 1*b:*
Figure 8:
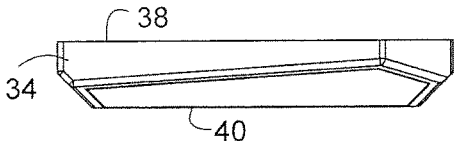
FIG. 8 is a top end view of the cell phone mount and wallet of FIG. 1*a;*
Figure 7:
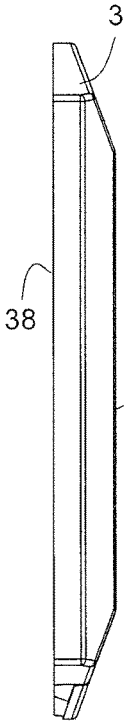
FIG. 7 is a left side view of the cell phone mount and wallet of FIG. 1*a;*
Figure 5:
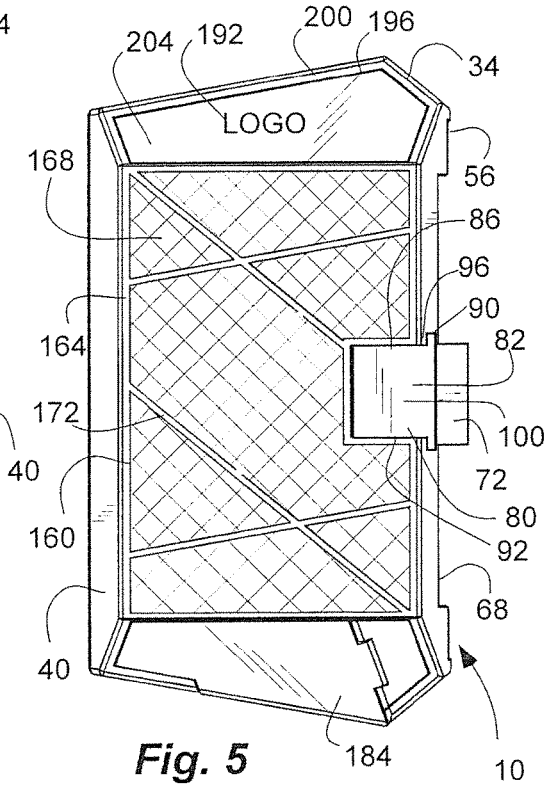
FIG. 5 is a front view of the cell phone mount and wallet of FIG. 1*a;*
Figure 6:
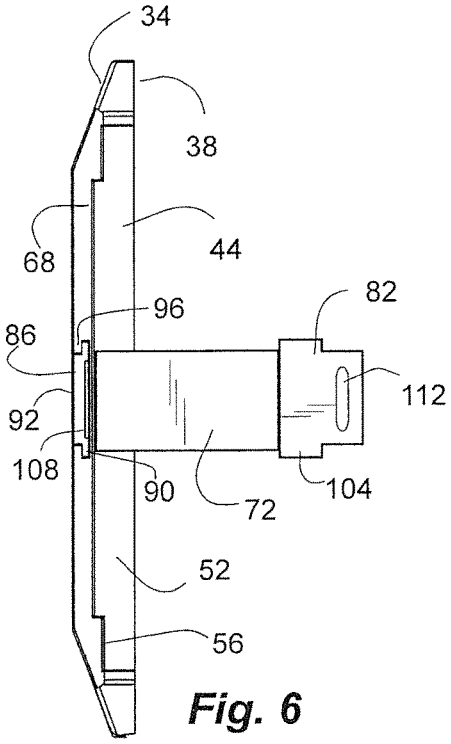
FIG. 6 is a right side view of the cell phone mount and wallet of FIG. 1*a;*
Figure 9:
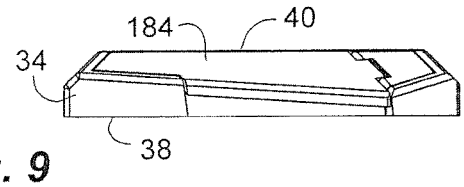
FIG. 9 is a bottom end view of the cell phone mount and wallet of FIG. 1*a;*
Figure 10:
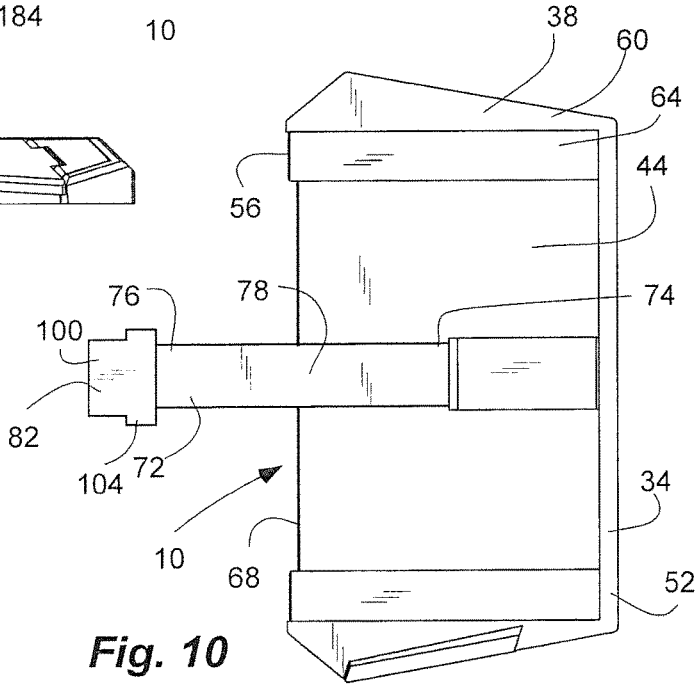
FIG. 10 is a rear view of the cell phone mount and wallet of FIG. 1*a;*
Figure 14:
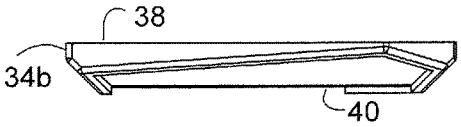
FIG. 14 is a top end view of the cell phone mount and wallet of FIG. 11.
Figure 11:
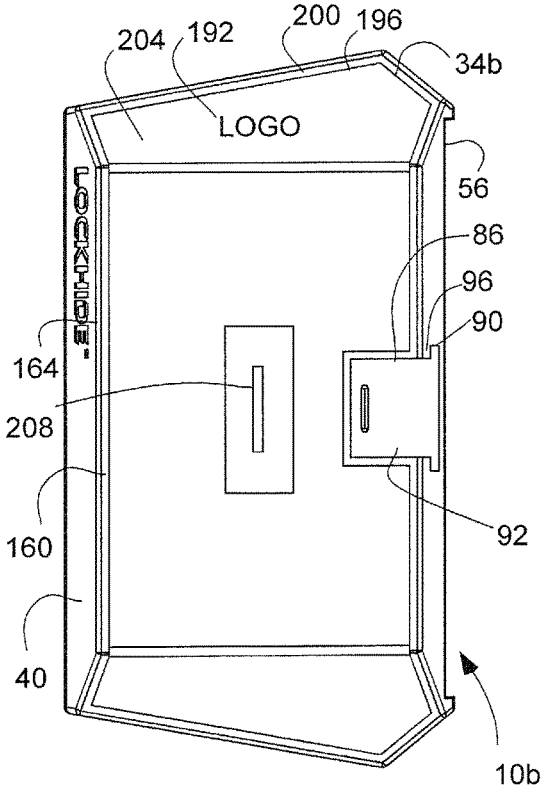
FIG. 11 is a front view of another cell phone mount and wallet in accordance with another example, shown with a sheet of hook-and-loop fastener and a strap removed.
Figure 12:
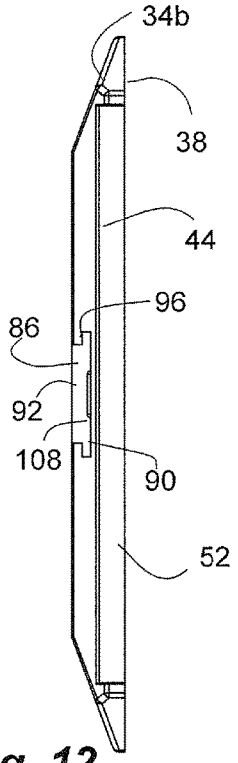
FIG. 12 is a right side view of the cell phone mount and wallet of FIG. 11.
Figure 13:
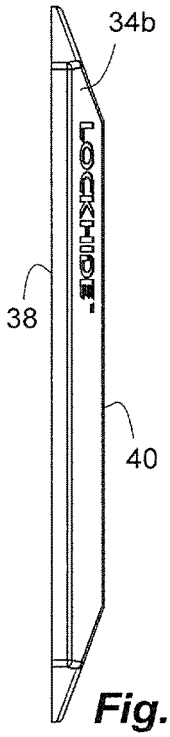
FIG. 13 is a left side view of the cell phone mount and wallet of FIG. 11.
Figure 15:
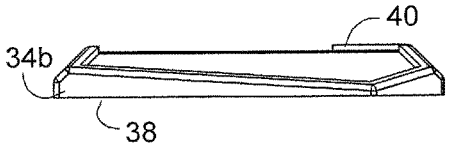
FIG. 15 is a bottom end view of the cell phone mount and wallet of FIG. 11.
Figure 16:
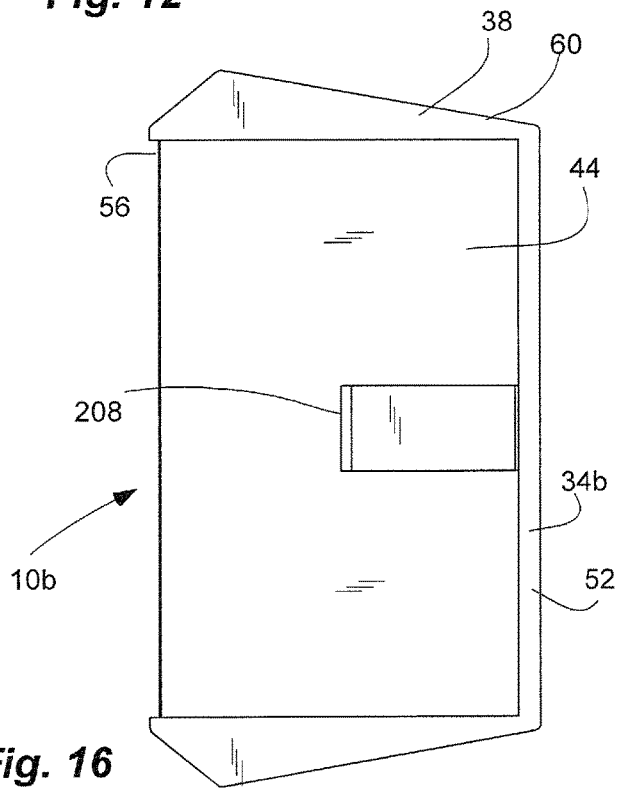
FIG. 16 is a rear view of the cell phone mount and wallet of FIG. 11.
Figure 17:
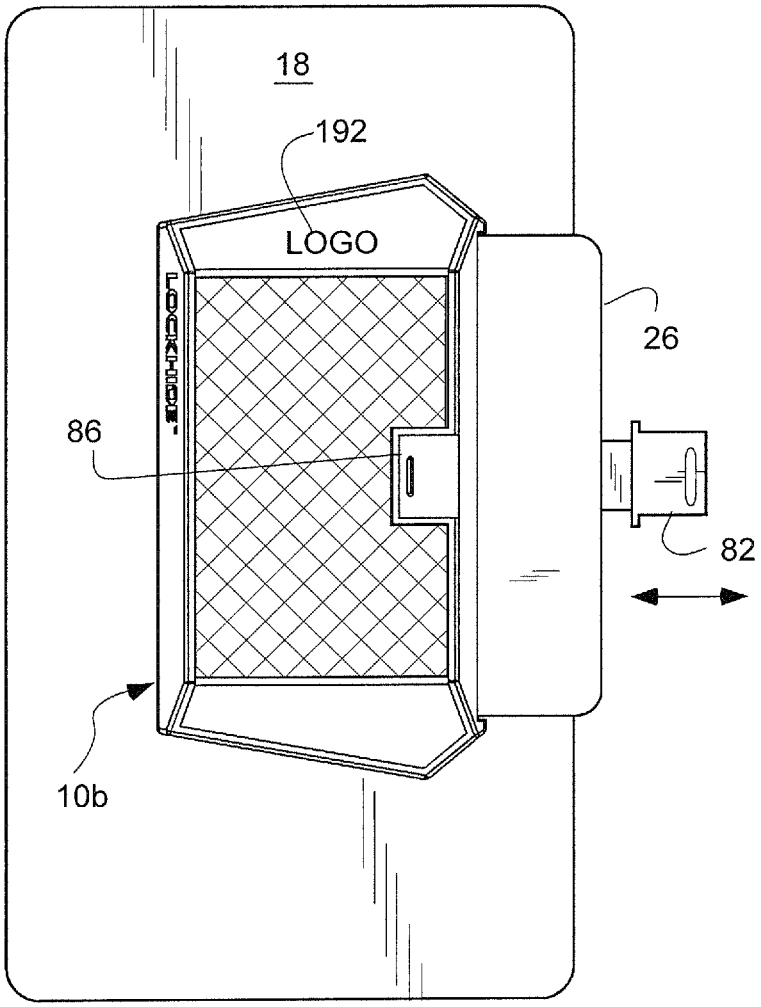
FIG. 17 is a front view of the cell phone mount and wallet of FIG. 11, shown disposed on a cell phone and with a strap in an open configuration.

Reference will now be made to the exemplary embodiments illustrated, and specific language will be used herein to describe the same. It will nevertheless be understood that no limitation of the scope of the invention is thereby intended.

DETAILED DESCRIPTION OF EXAMPLE EMBODIMENT(S)

Definitions

The terms "cell phone" and "cellular phone" are used interchangeably herein to refer broadly to a cellular phone, smart phone, phablet, or other handheld electronic device. In addition, the terms "cell phone" or "cellular phone" include any protective or decorative case or skin or film attached to the cellular phone. For example, the phrase "attached to a cellular phone" is intended to mean directly attached to the cellular phone, as well as indirectly attached by way of being attached to a protective or decorative case, skin or film. In addition, the term "cell phone" is used broadly herein to refer to a "mobile device" or a portable, handheld electronic device, including by way of example, a cellular (cell) phone, a smart phone, a tablet computer or tablet, a phablet, a mobile media player, and the like. Such cellular phones can be portable, handheld communication devices that can include a speaker, a microphone, a transmitter and a receiver (or transceiver), a power supply or battery, a display screen or touch screen display and input device, other input devices, such as one or more buttons, etc. The cellular phone can have a back or back surface, and a front or front surface. The display or touch screen can occupy a great majority of the front of the cellular phone.

The term "indicia" is used herein to refer to a visual element(s) that can convey information. The indicia can be embossed or raised, or debossed or lowered, in the material. The indicia can be formed by ink printed on the material or surface. The indicia can be indicative of or representing a business (or company or organization), a product or service, or both, such as a logo, message, slogan, etc. The logo or indicia can be or can include letters, symbols, figures, pictures, logos, art, corporate messages, slogans, bi-lines, icons, etc. that are associated with or that form a representation of a business, company or organization or the like, or a product, service or the like, or both. Thus, the indicia indicative of or representing a business (or company), a product, or both, such as a logo, is presented to the user, and thus becomes a promotion. Thus, the wallet and mount device or kit can be a promotional item and can be provided by businesses, corporations or other organizations, with indicia indicative of or representing a business (or company or organization), a product or service, or both, such as a logo, message, slogan, etc. The wallet and mount device or kit can be inexpensively manufactured, and in use, can occupy a position of high and frequent visibility. Thus, the wallet and mount device or kit can be inexpensively manufactured, and given away as a promotional item. In addition, the indicia can include instructions or directions for use, orientation, care, warnings, etc. The indicia can include instructions that can be related or unrelated to the use or care of the wallet and mount device or kit. For example, the instructions can include how to use or place the wallet and mount device. As another example, the instructions can relate to the use of something other than the wallet and mount device or kit itself, such as an item to be disposed thereon or therein.

The terms "interference fit" and "friction fit" are terms of art used interchangeably herein to refer to deliberately causing, increasing and/or using friction to deliberately resist movement. An interference fit or friction fit is different than and greater than the existence of friction. While friction may exist between any two surfaces, is often desirable to do all one can to reduce this friction. An interference fit or friction fit can be distinguished from naturally occurring friction by being actually deliberately caused and increased. An interference fit can be created by dimensioning engaging parts so that their surfaces tightly bear against one another. A friction lit can be created by surface roughness that is rougher.

The terms "card" and "credit card" are used interchangeably herein, and used broadly herein to refer to one or more credit cards and the like, such as driver's license, membership cards, etc.

The term hook-and-loop type fastener with a hook portion and a loop portion is used herein on various components. The location of the hoop and loop portions can be reversed.

The terms "indicia" and "indicium" are used interchangeably herein to refer to one or more indicia.

DESCRIPTION

Cell phones are carried and used by many people and are increasing being utilized as a replacement to wallets and/or purses. It is often still necessary to carry other items such as credit cards, membership cards, driver's license, cash, etc. In addition, a cell phone can also provide maps and directions so that it can be desirable to locate the cell phone on a dashboard of a vehicle.

A combination wallet and mount for a cell phone can provide a wallet affixed to the back of the cell phone to contain one or more cards or other items, as well as provide a surface that can be releasably secured to a dash mount. The wallet can have a shell with a recess that forms a pocket along with the back of the cell phone. Three of four sides of the shell can be closed and a fourth side can be open to receive the one or more cards into the pocket. In one aspect, the recess and/or the pocket can comprise two interconnected recesses or pockets of different sizes, including a primary recess or pocket for the cards, and a secondary recess or pocket for another item, such as cash. A strap can extend over the open side of the pocket to secure the cards in the pocket. The strap can have a fixed end fixed to the shell, an intermediate portion forming a loop in the pocket, and a free end releasably coupled to the shell, such as by a snap fit and/or a buckle. The loop can extend around the cards such that pulling on the free end draws the cards out of the pocket.

In addition, the shell can have an exterior side with a releasable attachment, such as one part of a hook-and-loop type fastener. A dash mount or base can have a foot affixable to the dash of a vehicle, and a mount plate coupled to the foot. The mount plate can have another part of the releasable attachment, such as another part of the hook-and-loop type fastener. A ball and socket joint can interconnect the mount plate and the foot such that the mount plate, and thus the phone, can be articulated with respect to the dash.

In addition, the wallet and mount can carry other features, such as a kickstand to extend from the wallet and maintain the cell phone at a desired viewing angle. In addition, the wallet and mount can provide an area for indicia indicative of or representing a business, a product, or both.

Furthermore, the wallet and the dash mount or base can be provided together in a kit. In another aspect, the dash mount or base can be provided with a card mount, without the wallet aspect, affixed to the back of the cell phone.

As illustrated in FIGS. 1*a*-3, a wallet and mount device 10 and/or a wallet and mount system or kit 14 is shown in an example implementation in accordance with the invention to removably mount a cellular phone 18 to a support surface 22, such as a dash of a vehicle, and to removably receive one or more cards 26 therein. The wallet 10 can be affixed to the back of the cell phone 18, and can carry one or more cards 26. In addition, the wallet 10, and thus the cell phone 18, can be mounted to a dash mount or base 30 that is affixed to the support surface 22.

Referring to FIGS. 1*a*-*c* and 5-10, an example of the wallet and mount device 10 is shown. The wallet 10 can comprise a rigid shell 34 that is affixed to the back of the cell phone 18. The rigid shell 34 can have an inner side 38 facing and abutting to the back the of the cell phone 18, and an exterior side 40 that is exposed with respect to the cell phone 18. In addition, the walled 10 and/or the shell 34 can have a recess 44 in the inner side 38 of the shell 34. The recess 44 can be sized and shaped to receive the one or more cards 26. The recess 44 can be open to the inner side 38 of the shell 34, and the inner side 38 of the shell 34 can be an open inner side. The open inner side of the shell 34 and the recess 44 or opening thereof can be closed by the cell phone 18. The recess 44 of the shell 34 can form a pocket 48 (FIG. 2*b*) along with the back of the cell phone 18 that is sized and shaped to receive the one or more cards 26. A perimeter wall 52 extends around a majority of the inner side 38 of the shell 34, and defines a majoring of a perimeter of the recess 44.

In one aspect, the perimeter wall 52 or the perimeter of the shell 34 can be tapered around a majority thereof, such as around three of four sides. The taper of the perimeter wall 52 can form an acute angle with respect to the inner side 38 of the shell 34. The taper of the perimeter wall 52 or the shell 34 can allow the wallet 10 to be inserted and removed from a pocket or purse and reduce catching on fabric or lips of the pocket or purse. The exterior side 40 of the shell 34 also comprises a substantially flat center between the perimeter wall 52. The perimeter wall 52 can form an obtuse angle with respect to the exterior side 40 of the shell 34 or the flat center thereof.

In one aspect, the recess 44 and the pocket 48 can be rectangular, and the perimeter wall 52 can form three sides of a rectangle. A gap 56 can be formed in perimeter wall 52 and can form the fourth side of the rectangle and an open perimeter side in the perimeter wall 52. The gap 56 defines an open slot into the recess 44 and the pocket 48 to receive the one or more cards 26 therethrough. An adhesive 60 can be disposed on the inner side 38 of the shell 34 and the perimeter wall 52 to affix the shell 44 to the back of the cell phone 18. The shell 34 can be formed of plastic and can be formed by injection molding.

In one aspect, the recess 44 of the shell 34 is a primary recess, and the shell 34 has a secondary recess 64 formed in the primary recess 44, or the recesses 44 and 64 are interconnected or share an open side or face. The secondary recess 64 can be smaller than the primary recess 44. The primary recess 44 can be wider to accommodate cards, while the secondary recess 64 can be narrower to accommodate another item 66, such as cash. The secondary recess 64 can be disposed on top of the primary recess 44. The gap 56 can be a primary gap in the perimeter wall 52 defining a primary open slot in the perimeter wall and extending into the primary recess 44, while a secondary gap 68 can be formed in the perimeter wall 52 or in the primary gap 56 to define a secondary open slot in the perimeter wall 52 and extending into the secondary recess 64.

The wallet 10 also has a closure for closing the gap 56 and 68 of the recess 44 and 64 and the open slot of the pocket 48 to secure the one or more cards in the recess 44 and the pocket 48. A strap 72 can selectively extend across the gap 56 and 68 and the open slot. The strap 72 has a proximal fixed end 74 affixed to the shell 34. In one aspect, the proximal fixed end 74 can extend through a hole in the exterior side 40 of the shell 34, as discussed below. In addition, the strap 72 can have an opposite distal free end 76 that can be releasably coupled to the shell 34. Furthermore, the trap 72 can have an intermediate portion 78 forming a loop in the recess 44 of the shell 34, and in the pocket 48. The intermediate portion 78 loops around the one or more cards 26 and/or items 66, and thus the strap 72 can be used to draw the one or more cards 26 and/or items 66 from the pocket 48.

The strap 72 can comprise a clasp 80 to releasably secure the distal free end 76 of the strap 72 to the shell 34. The clap 80 can comprise a buckle 82 on the distal free end 76 of the strap 72 removably received in a receptacle 86 in the shell 34. The receptacle 86 can be formed in the shell 34 adjacent to the gap 56. The buckle 82 can be attached to the distal free end 76 of the strap 72. The strap 72 and the buckle 82 have a closed configuration with the buckle 82 received in the receptacle 86, and the strap 72 extending around and over the one or more cards 26 (FIGS. 1*a*, 2*a* and 5) and/or items 66. In addition, the strap 72 and the buckle 82 have an open configuration with the buckle 82 removed from the receptacle 86 to release the one or more cards 26 (FIGS. 1*b*, 2*b* and 10) and/or items 66. In the open configuration, pulling on the buckle 82 and the strap 72 draws the one or more cards 26 and/or items 66 out of the receptacle 44 and the pocket 48, and through the open slot or gap 56 and 68.

The clasp 80 and/or the receptacle 86 further comprises a buckle opening 90 extending into the shell 34 from a lateral side and into the receptacle 86, and an outer opening 92 through the exterior side 40 of the shell 34 and into the receptacle 86. Thus, the buckle 82 and outer openings 90 and 92 can face in orthogonal directions. The outer opening 92 can be smaller than the buckle opening 90 to form a pair of opposite lips 96. The buckle 82 further comprises a finger pad 100 slidably disposed in the outer opening 92 when the buckle 82 is disposed in the receptacle 86. In addition, a pair of opposite wings 104 is slidably disposed in the buckle opening 90 and under the pair of opposite lips 96 when the buckle 82 is disposed in the buckle opening 90.

Furthermore, the buckle 82 and the receptacle 86 can form a snap fit, press fit, friction fit or resistance fit. The snap fit can comprise a detent removably disposed in a dimple. The detent 108 can extending from the receptacle 86, as shown, or from the buckle in another aspect. The dimple 112 can be formed in the buckle 82, as shown, or in the receptacle in another aspect.

Referring to FIGS. 1*a*-5, as described above, the wallet 10 can also form or can also be a mount, and can form part of a mount system or kit 14 to mount the wallet 10, and thus the cell phone 18, to a support surface 22, such as a dash or dashboard or console of a vehicle. The mount system or kit 14 can comprise the wallet and mount device 10 and one or more dash mounts or bases 30, as shown in FIG. 3. The dash mount or base 30 can be affixed to the support surface 22, such as the dash. A releasable attachment, such as a hook-and-loop attachment, can be formed between the wallet 10 and the dash mount or base 30 to releasably attach the wallet 10, and thus the cell phone 18, to the support surface 22. The dash mount or base 30 can comprise a foot 120 to be affixed to the support surface 22 and a mount plate 124 carried by the foot 120 and releasably coupled to the wallet 10. The foot 120 and the mount plate 124 can be interconnected by an articulated joint, such as a ball-and-socket joint, to movably position the mount plate 124, and the cell phone 18 thereon, with respect to the foot 120 and the support surface 22. The ball-and-socket joint can have a friction fit to maintain the relative position of the mount plate 124 with respect to the foot 120, and the cell phone 18 with respect to the support surface 22.

The foot 120 can have an adhesive 128 thereon to affix the foot 120 to the support surface 22. A neck 132 can extend from the foot 120. A ball 136 is disposed on the neck 132. The mount plate 124 is coupled to the ball 136 of the base 30 and the foot 120 with a socket 140 receiving the ball 136 therein, and defining the ball-and-socket joint between the foot 120 and the mount plate 124. The mount plate 124 can also have a face 144 opposite the socket 140. The face 144 can carry a sheet 148 comprising a portion of a hook-and-loop type fastener, such as the hook portion. The sheet 148 forms one portion of a releasable fastener, such as the hook portion of the hook-and-loop type fastener, to releasably couple the face 144 of the mount plate 124 to the exterior side 40 of the shell 34 of the wallet 10. In one aspect, the face 144 of the mount plate 124 can have an indentation 152 surrounded by a perimeter lip 156, or a majority thereof, such that the sheet 148 is disposed in the indentation 152.

The wallet 10 or the shell 34 can have the other portion of the hook-and-loop type fastener, such as the loop portion. Similarly, an indentation 160 can be formed in the exterior side of the shell 34 surrounded by a perimeter lip 164, or surrounding a majority of the exterior side of the shell 34. A sheet 168 is disposed in the indentation 160 of the shell 34 and is substantially circumscribed by the perimeter lip 164. The sheet 168 comprises a portion of a hook-and-loop type fastener, such as the loop portion. Recessing the sheet 168 in the shell 34 can resist undesirable coupling of the hook-and-loop type fastener, such as with objects in the pocket or purse. In one aspect, the sheet 168 and the portion of the hook-and-loop type fastener can extend out of the indentation 160 so that a depth of the indentation 160 and a height of the perimeter lip 164 is less than the thickness of the sheet 168. In another aspect, the sheet 168 and the portion of the hook-and-loop type fastener can be completely disposed in the indentation 160 so that a depth of the indentation 160 and a height of the perimeter lip 164 equal the thickness of the sheet 168. Transverse ribs 172 can extend through the indentation 160 and can intersect the sheet 168 to resist undesirable attachment to other objects.

Referring to FIG. 3, the mount system or kit 14 can be provided with one or more dash mounts or bases, which can be different. One base 30 can have a shorter neck 132, while another base 176 can have a longer neck 180, to accommodate different support surfaces 22, mounting preferences, etc. In addition, the base 30 can have a neck 132 that extends orthogonal to the foot 120, while the other base 176 can have a neck 180 that extends at an acute angle with respect to the foot 120.

Referring to FIG. 1*c*, a kickstand 184 can be pivotally coupled to the shell 34, and can pivot between a retracted position (FIGS. 5 and 9) recessed in a recess 188 the shell 34, and an extended position extending from the shell 34. Thus, the wallet 10 can be used to prop the cell phone 18 on a support surface 22, such as a table, at an inclined angle for viewing.

Referring again to FIGS. 1*a*, 1 *b* and 5, the wallet 10 and the exterior side 40 of the shell 34 can have indicia 192 thereon indicative of or representing a business, a product, or both. Thus, the wallet 10 and/or the mount system 14 or kit can be used as a promotional item. In one aspect, the exterior side 40 and/or the perimeter wall 52 of the shell 34 can have an indentation 196 with a perimeter lip 200 extending around a majority of the indentation 196. The indicia 192 can be disposed in the indentation 196 for protection. In another aspect, the indicia 192 can be carried by a polyurethane dome 204 disposed in the indentation 196, or on the exterior side 40 and/or the perimeter wall 52 of the shell 34. In one aspect, the polyurethane dome 204 can be transparent or translucent and the indicia 192 can be disposed under and visible therethrough.

Referring again to FIG. 2*b*, the proximal fixed end 74 of the strap 72 can extend through a hole 208 in the exterior side 40 of the shell 34, and between the sheet 168 and the exterior side 40 of the shell 34, to secure the strap 72 to the shell 34.

Referring to FIGS. 11-17, another wallet 10*b* or shell 34*b* is shown that is similar in most respects to that described above, and which description is hereby incorporated herein by reference. The wallet 10*b* and the shell 34 has a single recess 44 and a single pocket 48.

Figure 18:
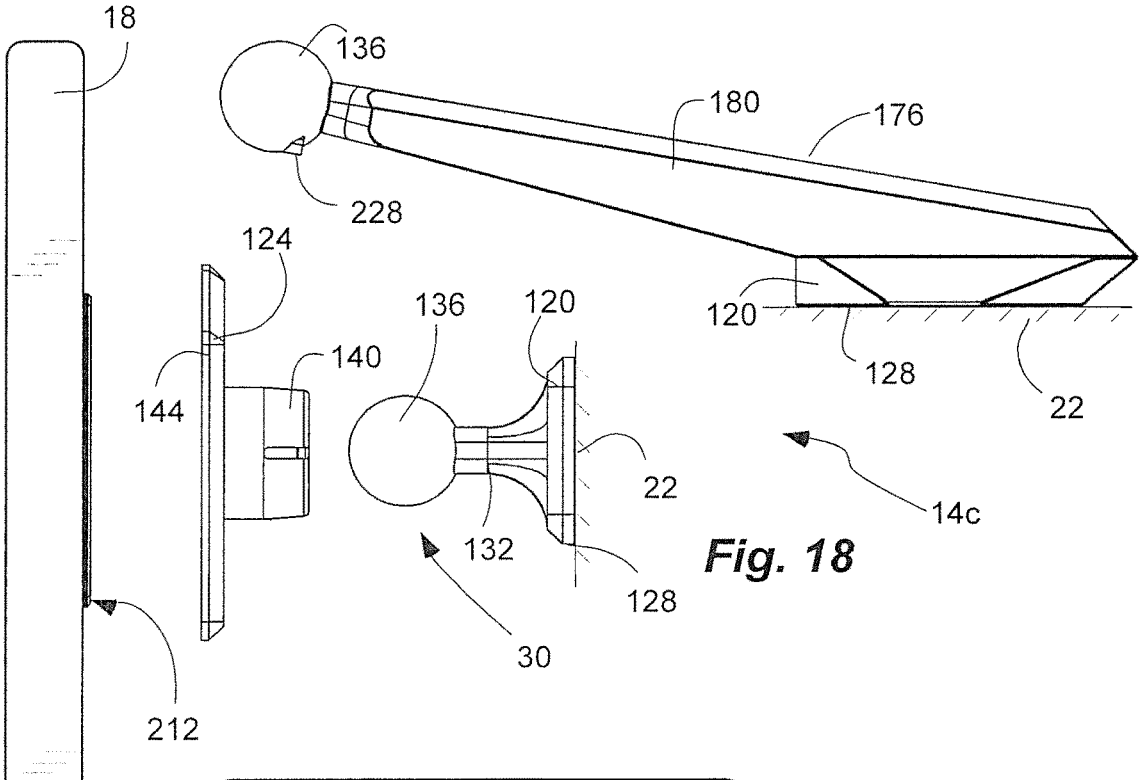
FIG. 18 is an exploded view of a kit with a cell phone mount in accordance with another example.
Figure 19:
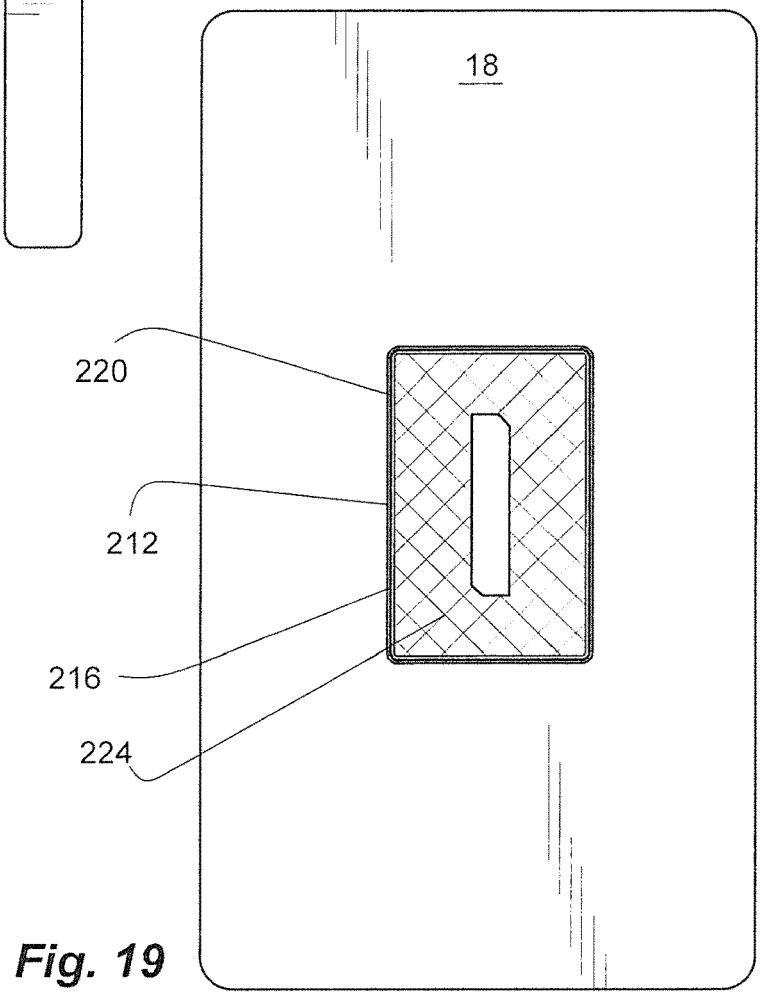
FIG. 19 is a front view of a mount card of the kit of FIG. 18, shown disposed on a cell phone.
Figure 20:
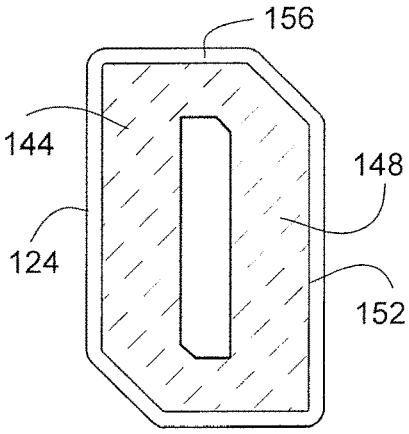
FIG. 20 is a front view of the mount plate of the kit of FIG. 18.

Referring to FIGS. 18-20, another mount system 14*c* is shown that is similar in many respects to that described above, and which description is hereby incorporated herein by reference. Rather than a wallet, the mount system 14*c* can have a mount card 212 affixed to the back of the cell phone 18. The mount card 212 can have the other portion of the hook-and-loop type fastener, such as the loop portion. The mount card 212 can be a tray with an indentation 216 formed in the exterior side of the mount card 212 surrounded by a perimeter lip 220, or surrounding a majority of the exterior side of the mount card 212. A sheet 224 is disposed in the indentation 216 of the mount card 212 and is substantially circumscribed by the perimeter lip 220. The sheet 224 comprises a portion of a hook-and-loop type fastener, such as the loop portion. Recessing the sheet 224 in the mount card 212 can resist undesirable coupling of the hook-and-loop type fastener, such as with objects in the pocket or purse. In one aspect, the sheet 224 and the portion of the hook-and-loop type fastener can extend out of the indentation 216 so that a depth of the indentation 216 and a height of the perimeter lip 220 is less than the thickness of the sheet 224. In another aspect, the sheet 224 and the portion of the hook-and-loop type fastener can be completely disposed in the indentation 216 so that a depth of the indentation 216 and a height of the perimeter lip 220 equal the thickness of the sheet 224. An adhesive can be disposed on the inner side of the mount card 212 to affix the mount card 212 to the cell phone 18. The mount card 212 can be formed of plastic, and thus does not interfere with wireless charging of the cell phone 18.

A method for removably securing a cellular phone 18 to a dashboard 22 of a vehicle, and for using the mounting systems 14 or 14*c* described above, comprises:

1) removably affixing the mount card 212, or the wallet 10, to the cell phone 18;
2) affixing the base 30 or 176 to the dashboard 22 of the vehicle;

3) placing the mount card 212 or the wallet 10 affixed to the cell phone 18 to the mount plate 124 of the base 30 or 176 affixed to the dashboard 22 of the vehicle with the hook-and-loop type fastener removably coupling the mount card 212 or the wallet 10 to the mount plate 124, and thus the cell phone 18 to the dashboard 22; and 4) removing the cell phone 18 from the base 30 or 176.

The hook-and-loop type fastener provide a positive mechanical attachment of the cell phone 18 to the base 30 or 178, and resist slipping (slip stop function) that can occur with magnetic attachments. In addition, the hook-and-loop type fastener can be recessed or embedded to resist interference when not mounted, and/or lateral catching. Furthermore, the ball-and-socket joint can allow orientation of the cell phone 18 with respect to the dash 22 and the viewer, while a tab 228 on the ball 136 can resist drooping of the cell phone 18 when the vehicle is jarred.

A method for carrying a card 26 with a cellular phone 18, and for using the wallet 10 described above, comprises:

1) affixing a wallet 10 to the cell phone 18;
2) removing the buckle 82 from the receptacle 92;
3) pulling the buckle 82, and thus the strap 72, away from the pocket 48 with the loop 78 of the strap drawing the one or more credit cards 26 out of the pocket 48;
4) removing the one or more credit cards 26 from the pocket;
5) replacing the one or more credit cards 26 into the pocket 48, and pushing the loop 78 of the strap 72 into the pocket 48; and
6) inserting the buckle 82 into the receptacle 92.

While the forgoing examples are illustrative of the principles of the present invention in one or more particular applications, it will be apparent to those of ordinary skill in the art that numerous modifications in form, usage and details of implementation can be made without the exercise of inventive faculty, and without departing from the principles and concepts of the invention. Accordingly, it is not intended that the invention be limited, except as by the claims set forth below.

The invention claimed is:

1. A wallet device configured for use with a cell phone, the wallet device comprising:

a) a rigid shell configured to be affixed to a back of the cell phone, and having an inner side and an exterior side;
b) a recess in the inner side of the shell sized and shaped to removably receive at least one card;
c) a perimeter wall extending around a majority of the inner side of the shell and defining a majority of a perimeter of the recess;
d) a gap in the perimeter wall defining an open slot into the recess, the open slot configured to receive the at least one card therethrough; and
e) an adhesive on the perimeter wall configured to affix the shell to the cell phone; and
f) the perimeter wall of the shell being tapered around a majority thereof and forming an acute angle with respect to the inner side of the shell.

2. The wallet device in accordance with claim 1 in combination with the cell phone, the combination comprising:

a) the shell affixed to the back of the cell phone and defining a pocket between with the recess of the shell and the cell phone, the pocket sized and shaped to removably receive the at least one card and the open slot being open to the pocket and configured to receive the at least one card therethrough; and
b) the pocket being rectangular with the perimeter wall forming three sides of a rectangle and the gap forming a forth side of the rectangle.

3. The wallet device in accordance with claim 1, wherein the shell has an open inner side configured to be closed by the cell phone and an open perimeter side formed by the gap in the perimeter wall.

4. The wallet device in accordance with claim 1, further comprising:

a strap with a proximal fixed end affixed to the shell, an intermediate portion forming a loop in the recess, and a distal free end releasably coupled to the shell and configured to secure the at least one card in the recess.

5. The wallet device in accordance with claim 4, further comprising a clasp, the clasp comprising:

a) a receptacle formed in the shell adjacent the gap;
b) a buckle attached to the distal free end of the strap and removably received in the receptacle, wherein the strap and the buckle have a closed configuration with the buckle received in the receptacle and the strap extending around and over the at least one card, and an open configuration with the buckle removed from the receptacle.

6. The wallet device in accordance with claim 5, wherein the receptacle of the clasp comprises:

a buckle opening extending into the shell from a lateral side and into the receptacle;
an outer opening through the exterior side of the shell and into the receptacle; and
the outer opening being smaller than the buckle opening to form a pair of opposite lips; and wherein the buckle comprises:

a finger pad slidably disposed in the outer opening when the buckle is disposed in the receptacle;
a pair of opposite wings slidably disposed in the buckle opening and under the pair of opposite lips when the buckle is disposed in the buckle opening.

7. The wallet device in accordance with claim 6, wherein the buckle and the receptacle form a snap fit comprising:

a) a detent extending from the receptacle or the buckle; and
b) a dimple formed in another of the receptacle or the buckle.

8. The wallet device in accordance with claim 1, wherein the recess of the shell is a primary recess; and wherein the shell further comprises a secondary recess formed in the primary recess and smaller than the primary recess; and wherein the gap comprises a primary gap in the perimeter wall defining a primary open slot in the perimeter wall and extending into the primary recess, and a secondary gap in the primary gap and defining a secondary open slot in the perimeter wall and extending into the secondary recess.

9. The wallet device in accordance with claim 1, further comprising a kickstand pivotally coupled to the shell, and pivoting between a retracted position recessed in the shell, and an extended position extending from the shell.

10. The wallet device in accordance with claim 1, further comprising:

a) an indentation in the exterior side of the shell;
b) a perimeter lip extending around a majority of the exterior side of the shell defining the indentation; and
c) a sheet disposed in the indentation of the shell and circumscribed by the perimeter lip, the sheet comprising a portion of a hook-and-loop type fastener.

11. The wallet device in accordance with claim 10, further comprising a base configured to removably couple the wallet device, and thus the cell phone, to a dashboard of a vehicle, the base comprising:

a) a foot;

b) an adhesive on the foot configured to affix the foot to the dashboard of the vehicle;

c) a neck extending from the foot;

d) a ball disposed on the neck;

e) a mount plate coupled to the ball of the foot, the mount plate comprising;

i) a socket receiving the ball of the foot and defining a ball-and-socket joint between the foot and the mount plate; and ii) a face opposite the socket with a sheet comprising a portion of a hook-and-loop type fastener, the face of the mount plate removably coupling to the exterior side of the shell.

12. The wallet device in accordance with claim 1, wherein the exterior side of the shell comprises a substantially flat center between the perimeter wall.

13. The wallet device in accordance with claim 1, further comprising:

a) a sheet disposed on the exterior side of the shell, the sheet comprising a portion of a hook-and-loop type fastener;

b) a hole in the exterior side of the shell;

c) a strap with a proximal fixed end extending through the hole in the exterior side of the shell and disposed between the sheet and the exterior side of the shell, and the strap having an intermediate portion forming a loop in the recess, and a distal free end releasably coupled to the shell and configured to secure the at least one card in the recess.

14. A wallet device configured for use with a cell phone, the wallet device comprising:

a) a rigid shell configured to be affixed to a back of the cell phone, and having an inner side and an exterior side;

b) a recess in the inner side of the shell sized and shaped to removably receive at least one card;

c) a perimeter wall extending around a majority of the inner side of the shell and defining a majority of a perimeter of the recess;

d) a gap in the perimeter wall defining an open slot into the recess, the open slot configured to receive the at least one card therethrough;

e) an adhesive on the perimeter wall configured to affix the shell to the cell phone f) an indentation in the shell;

g) a perimeter lip extending around a majority of the indentation; and h) indicia disposed in the indentation of the shell, the indicia being indicative of or representing a business, a product, or both.

15. The wallet device in accordance with claim 14, wherein the indicia comprises a polyurethane dome disposed in the indentation.

16. A wallet device configured for use with a cell phone, the wallet device comprising:

a) a rigid shell configured to be affixed to a back of the cell phone, and having an inner side and an exterior side;

b) a recess in the inner side of the shell sized and shaped to removably receive at least one card;

c) a perimeter wall extending around a majority of the inner side of the shell and defining a majority of a perimeter of the recess;

d) a gap in the perimeter wall defining an open slot into the recess, the open slot configured to receive the at least one card therethrough;

e) an adhesive on the perimeter wall configured to affix the shell to the cell phone;

f) an indentation in the exterior of the shell;

g) a perimeter lip extending around a majority of the exterior side of the shell defining the indentation; and h) a sheet disposed in the indentation of the shell and circumscribed by the perimeter lip, the sheet comprising a portion of a hook-and-loop type fastener.

17. The wallet device in accordance with claim 16, further comprising a base configured to removably couple the wallet device, and thus the cell phone, to a dashboard of a vehicle, the base comprising:

a) a foot;

b) an adhesive on the foot configured to affix the foot to the dashboard of the vehicle;

c) a neck extending from the foot;

d) a ball disposed on the neck;

e) a mount plate coupled to the ball of the base, the mount plate comprising;

i) a socket receiving the ball of the base and defining a ball-and-socket joint between the base and the mount plate; and ii) a face opposite the socket with a sheet comprising a portion of a hook-and-loop type fastener, the face of the mount plate removably coupling to the exterior side of the shell.

18. A wallet device configured for use with a cell phone, the wallet device comprising:

a) a rigid shell configured to be affixed to a back of the cell phone, and having an inner side and an exterior side;

b) a recess in the inner side of the shell sized and shaped to removably receive at least one card;

c) a perimeter wall extending around a majority of the inner side of the shell and defining a majority of a perimeter of the recess;

d) a gap in the perimeter wall defining an open slot into the recess, the open slot configured to receive the at least one card therethrough;

e) an adhesive on the perimeter wall configured to affix the shell to the cell phone; and f) a strap with a proximal fixed end affixed to the shell, an intermediate portion forming a loop in the recess, and a distal free end releasably coupled to the shell and configured to secure the at least one card in the recess.

19. The wallet device in accordance with claim 18, further comprising a clasp, the slap comprising:

a) a receptacle formed in the shell adjacent the gap; and b) a buckle attached to the distal free end of the strap and removably received in the receptacle, wherein the strap and the buckle have a closed configuration with the buckle received in the receptacle and the strap extending around and over the at least one card, and an open configuration with the buckle removed from the receptacle.

* * * * *